US006991542B2

(12) United States Patent
Asami et al.

(10) Patent No.: US 6,991,542 B2
(45) Date of Patent: Jan. 31, 2006

(54) GAME MACHINE, GAME MUSIC OUTPUT METHOD, INFORMATION STORAGE MEDIUM, GAME PROGRAM DISTRIBUTION DEVICE, AND GAME PROGRAM DISTRIBUTION METHOD

(75) Inventors: Yuichi Asami, Tokyo (JP); Atsumu Miyazawa, Tokyo (JP); Masafumi Sekiguchi, Tokyo (JP)

(73) Assignees: Konami Corporation, Tokyo (JP); KCE Tokyo Inc., Tokyo (JP)

( * ) Notice: Subject to any disclaimer, the term of this patent is extended or adjusted under 35 U.S.C. 154(b) by 11 days.

(21) Appl. No.: 09/778,055

(22) Filed: Feb. 7, 2001

(65) Prior Publication Data

US 2001/0012795 A1 Aug. 9, 2001

(30) Foreign Application Priority Data

Feb. 7, 2000 (JP) ..... 2000-029841

(51) Int. Cl.
*A63F 9/24* (2006.01)

(52) U.S. Cl. ..... 463/35 A

(58) Field of Classification Search ..... 463/1, 463/30–35, 40–44; 434/307 A; 84/453; 381/1–28; 273/454
See application file for complete search history.

(56) References Cited

U.S. PATENT DOCUMENTS

| | | | | |
|---|---|---|---|---|
| 5,592,609 A * | 1/1997 | Suzuki et al. | ..... | 463/31 |
| 5,753,844 A | 5/1998 | Matsumoto | | |
| 5,789,690 A | 8/1998 | Furuhashi et al. | | |
| 5,919,047 A * | 7/1999 | Sone | ..... | 434/307 A |
| 6,352,432 B1 * | 3/2002 | Tsai et al. | ..... | 434/307 A |
| 6,538,190 B1 * | 3/2003 | Yamada et al. | ..... | 84/636 |
| 2002/0094865 A1 * | 7/2002 | Araki et al. | ..... | 463/35 |

FOREIGN PATENT DOCUMENTS

| | | |
|---|---|---|
| CN | 1172319 A | 2/1998 |
| JP | 04-168492 | 6/1992 |
| JP | 5-217346 A | 8/1993 |
| JP | 8-115084 A | 5/1996 |
| JP | 9-230880 A | 9/1997 |
| JP | 10-222376 A | 8/1998 |
| JP | 11-003077 | 1/1999 |
| JP | 11-2119191 A | 8/1999 |
| JP | 11-338468 A | 12/1999 |
| JP | 2000-35785 A | 2/2002 |
| TW | 238378 | 1/1995 |

OTHER PUBLICATIONS

Korean Office Action dated Sep. 3, 2003.

* cited by examiner

*Primary Examiner*—Mark Sager
(74) *Attorney, Agent, or Firm*—Sughrue Mion, PLLC

(57) ABSTRACT

To output music other than original music, which is suitable to keep a player excited, in the place of a part of the original music, such as a beginning or ending thereof, which is unsuitable to serve as game music. When main part end timing TE arrives while outputting original music MO1, connection music MI2, correlated with original music MO2, which is next game music, begins playing. Subsequently, when original music reproduction start timing TP arrives while outputting the connection music MI2, reproduction of the original music MO2, correlated with the connection music MI2, begins

21 Claims, 8 Drawing Sheets

FIG. 4

| |
|---|
| ORIGINAL MUSIC DATA (PCM STREAM DATA) |
| CONNECTION MUSIC DATA (MIDI DATA) |
| STEP DATA |
| TIMING TABLE |
| BACKGROUND IMAGE DATA |
| MAIN PART START TIMING (TS) |
| MAIN PART END TIMING (TE) |
| ORIGINAL MUSIC REPRODUCTION START TIMING (TP) |

GAME MACHINE, GAME MUSIC OUTPUT METHOD, INFORMATION STORAGE MEDIUM, GAME PROGRAM DISTRIBUTION DEVICE, AND GAME PROGRAM DISTRIBUTION METHOD

BACKGROUND OF THE INVENTION

1. Field of the Invention

The present invention relates to a game machine, a game music output method, an information storage medium, a game program distribution device, and a game program distribution method. In particular, the present invention relates to a technique for outputting music other than original music, which is suitable to maintain a player's excitement, during a period corresponding to apart of the original music, such as a beginning or ending thereof, which is unsuitable to serve as game music, so that the game becomes more attractive.

2. Description of the Related Art

Arcade game machines and game software in which game music is output and a player operates an input device in accordance with the rhythm of the output game music so that the player can enjoy the feeling of playing music or dancing, are popular. A typical example of such a device or software may include "Beat Mania™" and "Dance, Dance, Revolution™" both manufactured and sold by Konami Corporation.

In such music-oriented games, operation timing data representing timing at which player operates an input device is prepared in accordance with the rhythm of music, and operation timing gradually approaching is shown on a display based on the operation timing data. The game player operates an input device while looking at the display and listening to the music. Performance of the game player is evaluated based on the amount of difference between the timing at which the player actually operated the input device and the timing defined by the operation timing data.

In such a music-oriented game, generally, any one of a plurality of pieces of game music are desirably or automatically selected as the game advances. One game stage is completed with the selected one piece of game music, and another piece of game music is selected for the next game stage. During an interval between the game stages, introduction of the next game music piece and so on is presented on a display.

With this arrangement, however, there is a discontinuation in the music between reproductions of one and next game music pieces. This causes the player's tension to be reduced, and the player's excitement is thereby also reduced.

In order to address this problem, a desired music-oriented game is of a type in which a plurality of pieces of game music are successively output with a shortest possible interval so that a player be able to stay excited. This type of music-oriented game machine, however, still has the following problem.

That is, many of the recent music-oriented games use general popular music and so on as game music. Such music often contains, at the beginning or ending thereof, a part with a slower tempo or smaller volume. Such a part is unsuitable to serve as game music to keep a player excited. Therefore, even though a plurality of pieces of game music are successively output with a shortest possible interval to ensure the shortest possible period with discontinued game music, the player's tension is still reduced at the beginning or ending of each game music piece. Moreover, this problem is not limited to a music-oriented game only.

In view of the above, achievement of an arrangement in which music suitable to keep a player excited is reproduced overlapping with or instead of a part of original music, such as the beginning or ending thereof, which is unsuitable to keep a player excited, would enable not only music-oriented games but also other types of game machines to be made more attractive.

SUMMARY OF THE INVENTION

The present invention has been conceived in view of the above, and aims to provide a game machine allowing output of music other than original music, which is suitable to keep a player excited, during a period corresponding to a part of the original music, such as a beginning or ending thereof, which is unsuitable to keep the player excited. The present invention also aims to provide a game music output method, an information storage medium storing a game program, a game program distribution device, and a game program distribution method for achieving such a game machine.

In order to achieve the above object, according to one aspect of the present invention, there is provided a game machine comprising first original music output means for outputting at least a main part of first original music containing the main part and a post-amble subsequent thereto; second original music output means for outputting at least a main part of second original music containing a preamble and the main part subsequent thereto; connection music output means for outputting predetermined connection music; and timing control means for controlling the second original music output means and the connection music output means such that main part end timing of the first original music coincides with start timing of the connection music, and that main part start timing of the second original music coincides with output end timing of the connection music.

"A main part" here means a part of original music, which is suitable to serve as game music. "A preamble" means a part preceding a main part, which is unsuitable to serve as game music. "A post-amble" means a part subsequent to a main part, which is unsuitable to serve as game music.

According to the present invention, connection music begins outputting upon completion of outputting the main part of the first original music, and the main part of the second original music begins outputting upon completion of outputting the connection music. Therefore, selection of connection music suitable to serve as game music enables continuous playing of appropriate game music even in the case where original music pieces are successively reproduced. This makes it possible to provide an attractive game machine capable of keeping a player excited.

In one embodiment of the present invention, the above game machine may further comprise volume control means for controlling an output volume of the post-amble of the first original music. This arrangement makes it possible to avoid a situation where the post-amble of first original music is heard at a large volume during a period when connection music is output.

In another embodiment of the present invention, the above game machine may further comprise volume control means for controlling an output volume of the preamble of the second original music. This arrangement can prevent a situation where the preamble of the second original music is heard at a large volume while outputting the connection music.

In still another embodiment of the present invention, a tempo of the connection music is determined based on a tempo of the main part of the first original music. This arrangement enables smooth transition from the main part of the first original music to the connection music.

In still another embodiment of the present invention, a tempo of the connection music is determined based on a tempo of the main part of the second original music. This arrangement enables smooth transition from the connection music to the main part of the second original music.

In still another embodiment of the present invention, the above game machine may further comprise connection music tempo control means for controlling a tempo of the connection music so as to gradually vary from a tempo based on a tempo of the main part of the first original music to a tempo based on a tempo of the main part of the second original music. This arrangement enables smooth transitions from the main part of the first original music to the connection music, and from the connection music to the main part of the second original music.

According to another aspect of the present invention, there is provided a game machine comprising original music storage means for storing audio data concerning at least a main part of original music containing the main part and a post-amble subsequent thereto; connection music storage means for storing audio data concerning predetermined connection music; original music output means for outputting the main part of the original music based on the audio data concerning the main part; connection music output means for outputting the connection music based on the audio data concerning the predetermined connection music during a period when at least the post-amble of the original music must be output after completion of outputting the main part.

According to the present invention, connection music is output overlapping with or in the place of a post-amble of original music during a period when the post-amble must be output. This arrangement enables continuous provision of appropriate music to the player even during a period when a post-amble must be output.

According to still another aspect of the present invention, there is provided a game machine comprising original music storage means for storing audio data concerning at least a main part of original music containing a preamble and a main part subsequent thereto; connection music storage means for storing audio data concerning predetermined connection music; original music output means for outputting the main part of the original music based on the audio data concerning the main part; connection music output means for outputting the connection music based on the audio data concerning the predetermined connection music during a period when at least the preamble of the original music must be output before the start of outputting the main part.

According to the present invention, connection music is output overlapping with or in the place of a preamble of original music during a period when the preamble must be output. This arrangement enables continuous provision of appropriate music to the player even during a period when a preamble must be output.

In one embodiment of the present invention, a tempo of the connection music is determined based on a tempo of the main part of the original music. This arrangement allows the connection music to take over the tempo of the main part of the original music.

According to yet another aspect of the present invention, there is provided a game machine comprising original music storage means for storing audio data concerning original music containing a main part and a post-amble subsequent thereto; original music end timing storage means for storing main part end timing data indicative of main part end timing of the original music; connection music storage means for storing audio data concerning predetermined connection music; original music reproduction means for outputting the original music based on the audio data concerning the original music; main part end timing monitoring means for monitoring main part end timing based on the main part end timing data while outputting the original music; connection music output means for starting outputting the connection music upon arrival of the main part end timing; and original music volume control means for reducing an output volume of the original music upon arrival of the main part end timing.

According to the present invention, connection music is output upon completion of outputting the main part of the original music. This arrangement enables continuous provision of appropriate music to the player even during a period when a post-amble must be output. In addition, interference between the post-amble of the original and the connection music can be avoided because an output volume of the post-amble is then set at, for example, zero.

According to yet another aspect of the present invention, there is provided a game machine, comprising original music storage means for storing audio data concerning original music containing a preamble and a main part subsequent thereto; main part start timing storage means for storing main part start timing data indicative of main part start timing of the original music; connection music storage means for storing audio data concerning predetermined connection music; original music reproduction start timing storage means for storing original music reproduction start timing data indicative of original music reproduction start timing during a period when the connection music is output; connection music output means for outputting the connection music based on the audio data concerning the connection music; original music reproduction start timing monitoring means for monitoring original music reproduction start timing based on the original music reproduction start timing data during a period when the connection music is output; original music reproduction means for starting reproduction of the original music while suppressing an output volume for the original music, upon arrival of original music reproduction start timing; main part start timing monitoring means for monitoring main part start timing based on the main part start timing data after reproduction of the original music was started; and original music volume control means for increasing an output volume for the original music upon arrival of the main part start timing.

According to the present invention, reproduction of the original music begins with its output volume suppressed when original music reproduction timing arrives during a period when the connection music is output, and the output volume is increased when main part start timing thereafter arrives. This arrangement enables provision of connection music to the player even during a period when the preamble of the original music must be output. In addition, interference between the preamble and the connection music can be prevented as an output volume of the original music is suppressed during a period for the preamble.

In one embodiment of the present invention, the original music reproduction means begins reproduction of the original music with its output volume set at zero. This arrangement enables complete elimination of interference between the preamble and the connection music.

According to yet another aspect of the present invention, there is provided a game music output method comprising an original music output step of outputting at least a main part of first original music containing the main part and a post-amble subsequent thereto; and a connection music output step of outputting predetermined connection music during a period when the post-amble of the original music must be output.

According to yet another aspect of the present invention, there is provided an information storage medium storing a program for causing a computer to execute an original music output step of outputting at least a main part of first original music containing the main part and a post-amble subsequent thereto; and a connection music output step of outputting predetermined connection music during a period when the post-amble of the original music must be output.

According to the present invention, the connection music can be provided to the player even during a period when a post-amble must be output. Therefore, selection of connection music suitable to serve as game music allows the player to stay excited.

According to yet another aspect of the present invention, there is provided a game music output method comprising an original music output step of outputting at least a main part of second original music containing a preamble and the main part subsequent thereto; and a connection music output step of outputting predetermined connection music during a period when the preamble of the original music must be output.

According to yet another aspect of the present invention, there is provided an information storage medium storing a program for causing a computer to execute an original music output step of outputting at least a main part of second original music containing a preamble and the main part subsequent thereto; and a connection music output step of outputting predetermined connection music during a period when the preamble of the original music must be output.

According to the present invention, the connection music can be provided to the player even during a period when a preamble must be output. Therefore, selection of connection music suitable to serve as game music allows the player to stay excited.

According to yet another aspect of the present invention, there is provided a game music output method comprising a first original music output step of outputting at least a main part of first original music containing the main part and a post-amble subsequent thereto; a second original music output step of outputting at least a main part of second original music containing a preamble and the main part subsequent thereto; and a connection music output step of outputting predetermined connection music during a period between main part end timing of the first original music and main part start timing of the second original music.

According to yet another aspect of the present invention, there is provided an information storage medium storing a program for causing a computer to execute a first original music output step of outputting at least a main part of first original music containing the main part and a post-amble subsequent thereto; a second original music output step of outputting at least a main part of second original music containing a preamble and the main part subsequent thereto; and a connection music output step of outputting predetermined connection music during a period between main part end timing of the first original music and main part start timing of the second original music.

According to yet another aspect of the present invention, there is provided a game program distribution device for distributing a program for causing a computer to execute a first original music output step of outputting at least a main part of first original music containing the main part and a post-amble subsequent thereto; a second original music output step of outputting at least a main part of second original music containing a preamble and the main part subsequent thereto; and a connection music output step of outputting predetermined connection music during a period between main part end timing of the first original music and main part start timing of the second original music.

According to yet another aspect of the present invention, there is provided a game program distribution method for distributing a program for causing a computer to execute a first original music output step of outputting at least a main part of first original music containing the main part and a post-amble subsequent thereto; a second original music output step of outputting at least a main part of second original music containing a preamble and the main part subsequent thereto; and a connection music output step of outputting predetermined connection music during a period between main part end timing of the first original music and main part start timing of the second original music.

According to the present invention, the connection music begins outputting upon completion of outputting the main part of the first original music, and the main part of the second original music begins outputting upon completion of outputting the connection music. Therefore, selection of connection music suitable to serve as game music enables continuous playing of appropriate game music even during a period when original music pieces are successively output. This makes it possible to provide an attractive game capable of keeping the player excited.

According to a game program distribution device and a game program distribution method of the present invention, a demander can easily obtain a game, unique to the present invention, which outputs connection music even during a period when a preamble or post-amble must be output so that the player can be kept excited.

According to yet another aspect of the present invention, there is provided a game machine having a controller operated by a player in accordance with game music comprising original music output means for outputting, as a part of the game music, at least a main part of original music containing a preamble, the main part, and a post-amble in this order; connection music output means for outputting predetermined connection music; original music determination means for determining next original music to output; timing control means for controlling the original music output means and the connection music output means such that the connection music is output during a period between main part end timing of original music currently output and main part start timing of the next original music to output.

According to the present invention, the original music determination means determines next original music to output. The connection music begins outputting when the main part of the original music finishes outputting, and the main part of the next original music begins outputting when the connection music finishes outputting. Therefore, selection of connection music suitable to serve as game music enables continuous playing of appropriate game music. In addition, because the main part of the original music and the connection music can be output endlessly, there can be provided a more attractive game machine.

According to yet another aspect of the present invention, there is provided a game machine having a controller operated by a player in accordance with game music comprising input means for setting a play condition including a number of players and difficulty; play condition storage means for storing the play condition set; and game advancing means for advancing a game according to the play condition stored during successive reproduction of the game music based on a plurality of pieces original music. In this machine, the game advancing means includes original music output means for outputting, as a part of the game music, at least a main part of original music containing a preamble, the main part, and a post-amble in this order; connection music output means for outputting predetermined connection music; original music determination means for determining next original music to output; and timing control means for controlling the original music output means and the connection music output means such that the connection music is output during a period between main part end timing of the original music currently output and main part start timing of the next original music to output.

According to the present invention, play conditions including the number of players and a level of difficulty are set using the input means, and stored in the play condition storage means.

The game advancing means advances a game according to the stored play conditions. As the game advances, a plurality of pieces of original music are successively reproduced and output as game music. In this invention, in particular, the original music determination means determines next original music to output. The connection music begins outputting when the main part of the original music finishes outputting, and the main part of the next original music begins outputting when the connection music finishes outputting. Therefore, selection of connection music suitable to serve as game music enables continuous playing of appropriate game music. In addition, because the main part of the original music and the connection music can be output endlessly, there can be provided a more attractive game machine.

In one embodiment of the present invention, the game advancing means may further comprise timing guidance image display means for displaying a timing guidance image in conformity with the play condition stored in the play condition storage means, for guiding timing at which the player is to operate the controller in accordance with the game music. With this arrangement, the player can know, by referring to the timing guidance screen image, timing at which to operate the controller. In addition, as the timing guidance screen image is in conformity with the play condition, the player can enjoy the game under the guidance in conformity with the play conditions set.

In another embodiment of the present invention, in the above game machine, the original music determination means determines original music to output based on a random number. As this arrangement enables outputting of game music pieces in an order unexpected to the player, the player does not become tired of the game.

BRIEF DESCRIPTION OF THE DRAWINGS

The above and the other objects, features, and advantages of the present invention, will become further apparent from the following description of the preferred embodiment taken in conjunction with the accompanying drawings wherein:

FIG. 4 is a diagram showing a configuration of game music data;

PREFERRED EMBODIMENTS OF THE PRESENT INVENTION

The entire disclosure of the corresponding Japanese application 2000-29841 filed on Feb. 7, 2000, including specification, claims, drawings and summary, are incorporated herein by reference.

In the following, preferred embodiments of the present invention will be described in detail with reference to the accompanying drawings.

Figure 1:
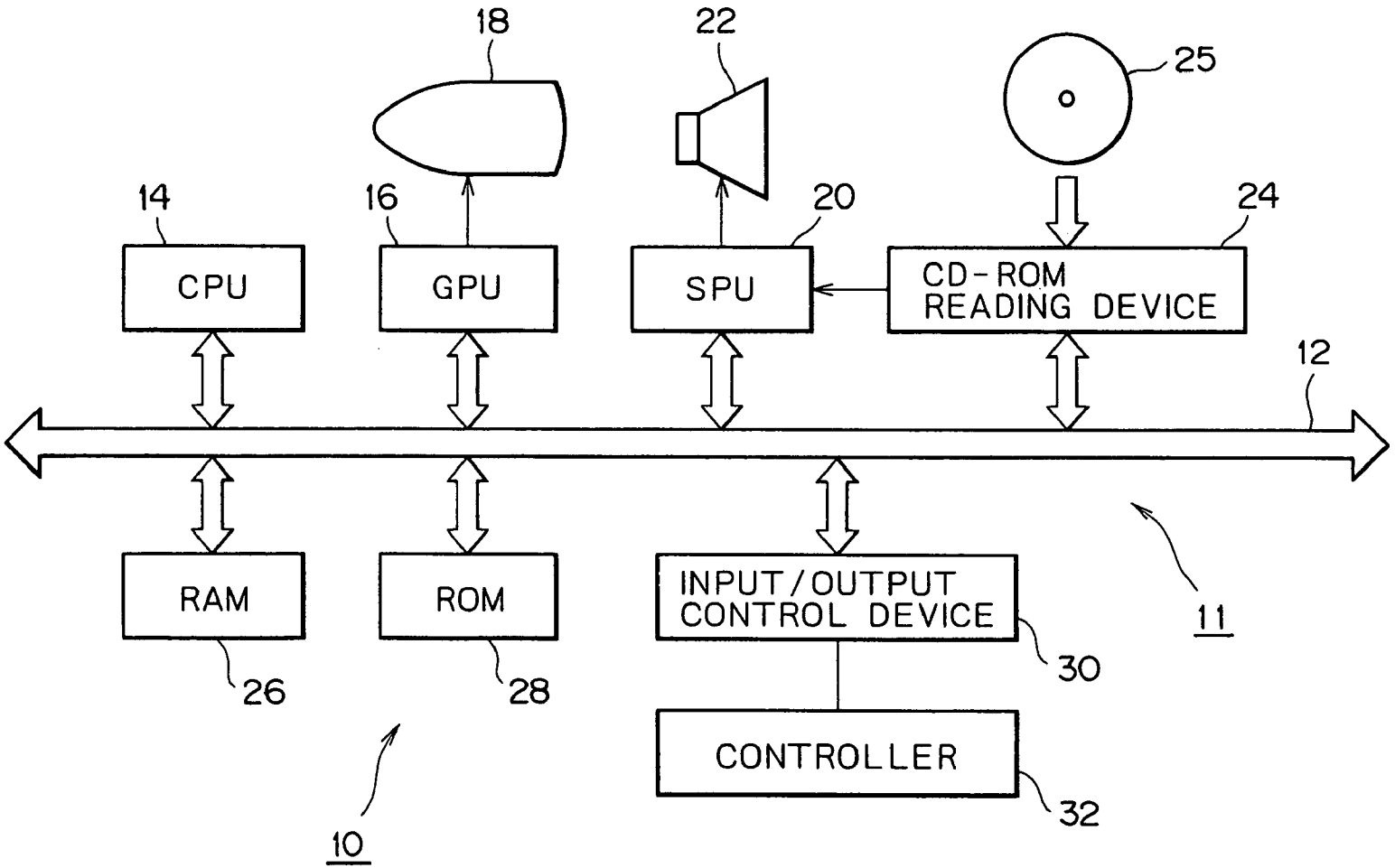
FIG. 1 is a diagram showing a structure of a game machine according to one preferred embodiment of the present invention.

FIG. 1 is a diagram showing a structure of a game machine according to a preferred embodiment of the present invention. A device 10 comprises a CD-ROM 25, or an information storage medium, mounted to a home-use game machine 11, which is in turn connected to a monitor 18 and a speaker 22. Note that although a CD-ROM 25 is used here to supply a game program and game data to the home-use game machine 11, any other information storage media, such as a DVD or a ROM card, may be used instead. Alternatively, a game program and game data may be remotely supplied to the home-use game machine 11 via a communication network, as will be described later.

A home-use game machine 11 comprises a CPU 14, a GPU 16, an SPU 20, a CD-ROM reader 24, a RAM 26, a ROM 28, and an input/output control device 30, mutually connected via a bus 12 for data exchange, particularly the input/output control device 30 being further connected to a controller 32 via a cord. The respective elements of the home-use game machine 11 other than the controller 32 are all accommodated in a predetermined single housing. By way of example, the monitor 18 may be a home TV receiver, and the speaker 22 may be a speaker incorporated into the home TV receiver.

The CPU 14 has a structure comprising a micro processor, and controls the respective elements of the home-use game machine 11 based on an operating system stored in the ROM 26 and a game program read from the CD-ROM25. The bus 12 is used for exchanging addresses and data among the respective elements of the home-use game machine 11. The ROM 28 stores an operating system, which is a basic program indispensable for comprehensive operation of the home-use game machine 11. The RAM 26 is used for storing game programs and game data read from the CD-ROM 25 as necessary. The GPU (graphics processing unit) 16, which has a structure comprising a frame buffer, receives image data from the CPU 14, and draws a game screen image in the frame buffer based on the received input data. The GPU 16, moreover, converts the content of the frame buffer into a video signal, and outputs the signal to the monitor 18 at predetermined timing.

An SPU (sound processing unit) 20, which has a structure comprising a sound buffer, reproduces music data, game sound effects, and so on, which are read from the CD-ROM 25 and stored in the sound buffer, and outputs sounds via the speaker 22. The CD-ROM reader 24, in response to an instruction from the CPU 14, reads a game program and game data from the CD-ROM 25. In this embodiment, the CD-ROM 25 stores a game program and game data for implementing a music game.

The input/output control device 30 is an interface for connecting one or more external input/output devices to the home-use game machine 11. A controller 32 is detachably connected to the control device 30 in this embodiment. Alternatively, an auxiliary storage device, such as a memory card, or an external communication device, such as a modem or a terminal adapter, may be connected. A controller 32 is an input means via which a player operates a game, and has various buttons. The input/output control device 30 periodically (for example, every 1/60 seconds) scans the operation states of the various buttons of the controller 32, and supplies a signal indicative of the scanning result to the CPU 14 via the bus 12. Based on the signal, the CPU 14 judges the player's game operation.

Figure 2:
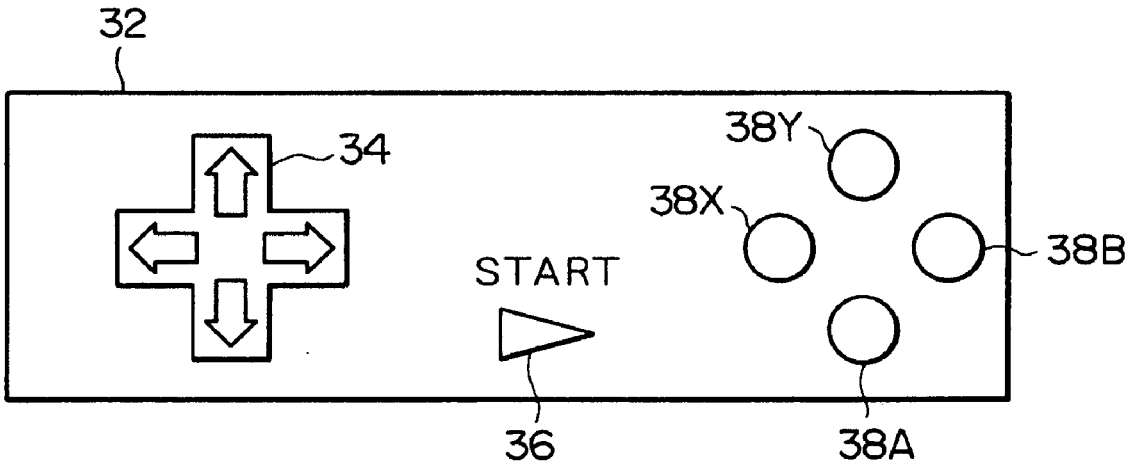
FIG. 2 is a diagram showing an appearance of an example of a controller.

FIG. 2 is a diagram showing an example of the controller 32. The controller 32 shown, generally used in various games, has buttons on the surface thereof, including a direction button 34, a start button 36, and buttons 38X, 38Y, 38A, 38B. The direction button 34 is a cross-shaped button generally used in designating a direction in which a character or a cursor is to move. The start button 36 is a small, triangular press button generally used to either start or forcibly end a game. The buttons 38X, 38Y, 38A, 38B are generally used for other game operations.

Figure 3:
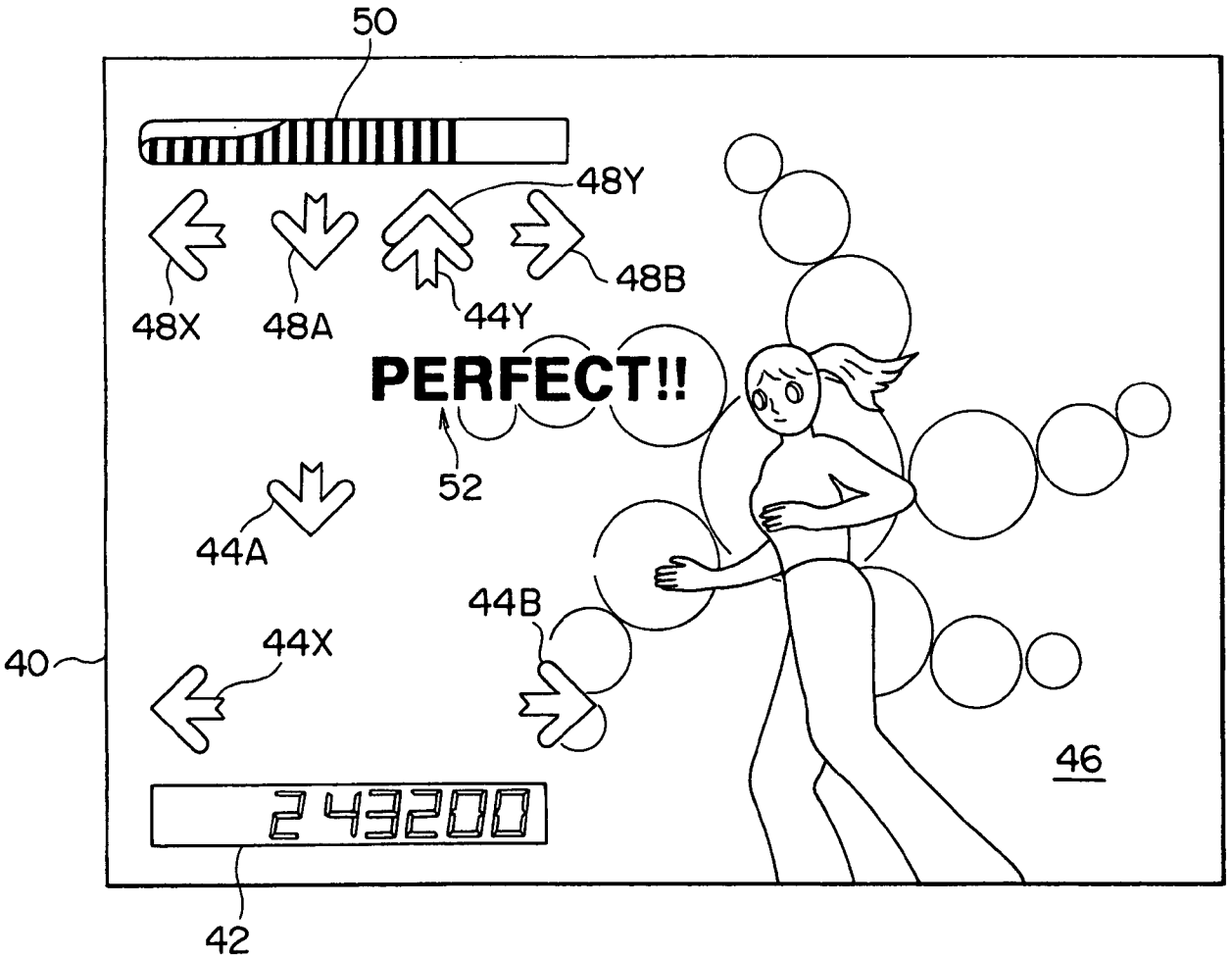
FIG. 3 is a diagram showing an example of a game screen image.

FIG. 3 is a diagram showing an example of a game screen image displayed in the monitor 18 based on a game program and game data read from the CD-ROM 25. As shown, a background image 46 is displayed over the entire game screen 40, and a dance gauge 50, reference arrows 48X, 48A, 48Y, 48B, timing guidance arrows 44X, 44A, 44Y, 44B, a score 42, and a message 52 are displayed superimposed thereupon. The score 42, which is shown on the left lowermost part in the game screen 40, indicates a score accumulated thus far. The message 52, which is shown in the center-left part of the screen, constitutes of an expression evaluating the player's operation, such as "Great", "Perfect", "Good", "Boo", and so on.

The dance gauge 50, which is shown in the left uppermost part in the screen image, comprises a gauge bar which extends or contracts depending on the finess with which the game is operated. Specifically, the gauge bar may extend to the right in response to a highly evaluated game operation, and contract to the left in response to a poorly evaluated game operation. As a game ends soon after the gauge bar becomes shorter than a predetermined length, the player can know by referring to the dance gauge 50 whether or not the game will end soon. Below the dance gauge 50 are shown reference arrows 48X, 48A, 48Y, 48B in this order, which serve as a reference for the player to refer to know operation timing.

That is, the arrow 48X is correlated with a button 38X and a leftward operation of the direction button 34. Similarly, the arrows 48A, 48Y, 48B are correlated with a button 38A and a downward operation of the direction button 34, with a button 38Y and an upward operation of the direction button 34, and with a button 38B and a rightward operation of the direction button 34, respectively. In a relatively large screen area below the reference arrows 48X, 48A, 48Y, 48B, timing guidance arrows 44X, 44A, 44Y, 44B are shown, which move upward as time elapses. A player can obtain a higher score by operating, at a time when each of the timing guidance arrows 44X, 44A, 44Y, 44B overlap with a corresponding one of the reference arrows 48X, 48A, 48Y, 48B, the direction button 34 in a corresponding direction or pressing a corresponding one of the buttons 38X, 38A, 38Y, 38B. In the example of FIG. 3, where the timing guidance arrow 44Y is about to overlap with the reference arrow 48Y, a player operating the controller 32 at a time a little later than the timing shown in the drawing by either pressing the button 38Y or operating the direction button 34 upward, would obtain a higher score.

It should be noted that a player does not always have to operate the controller 32 at a very exact timing when the timing guidance arrows 44X, 44A, 44Y, 44B fully overlap with the corresponding reference arrows 48X, 48A, 48Y, 48B in order to get a score. A player can rather get a score that takes into consideration the extent of overlapping. Note that the timing guidance arrows 44X, 44A, 44Y, 44B are displayed based on step data (described later).

The timing guidance arrows 44X, 44A, 44Y, 44B are specifically displayed as follows. That is, after the start of game music reproduction, the CPU 14 reads, from the step data, operation timing within a guidance display range, and generates image data representing the timing guidance arrows 44X, 44A, 44Y, 44B based on the step data. Note that a guidance display range is a range determined here as covering two bars subsequent to the current moment. Image data is configured such that a timing guidance arrow relative to the closest operation timing is displayed in the uppermost part in the timing guidance arrow display area with those relative to farther operation timings displayed in lower parts accordingly.

In displaying the arrows, for example, the timing guidance arrow 44X, indicative of timing of a leftward operation of the direction button 34 and a pressing operation of the button 38X, is shown below the reference arrow 48X, associated with these operations. Similarly, timing guidance arrow 44A, indicative of timing of a downward operation of the direction button 34 and a pressing operation of the button 38A, is shown below the reference arrow 48A, associated with these operations; timing guidance arrow 44Y, indicative of timing of an upward operation of the direction button 34 and a pressing operation of the button 38Y, is shown below the reference arrow 48Y, associated with these operations; and a timing guidance arrow 44B, indicative of timing of a rightward operation of the direction button 34 and a pressing operation of the button 38B, is shown below the reference arrow 48B, associated with these operations. It should be noted that, although single guidance arrows 44X, 44A, 44Y, 44B are shown in a single column in this drawing, two or more timing guidance arrows 44X, 44A, 44Y, 44B may be shown at the same time in a single column depending on the approaching state of operation timings. The thus generated image data is superimposed onto the background screen image 46, constituting a part of the game screen 40. The above processing will be repeated in a predetermined cycle.

The head of the guidance display range corresponds to the currently playing position in the game music, and the guidance display range moves toward the end of the music by a predetermined amount each process. Accordingly, the timing guidance arrows 44X, 44A, 44Y, 44B gradually move upward as the music progresses. With the timing guidance arrows 44X, 44A, 44Y, 44B displayed as described above, a player referring to the game screen 40 can easily anticipate the arrival of operation timing.

Next, data recorded in a CD-ROM 25 will be described. The CD-ROM 25 stores not only a game program, various game effect sound data, and various game image data, which are necessary to play a music game using a home-use game machine 11, but also game music data which is necessary for executing a game program. FIG. 4 is a diagram describing game music data stored in the CD-ROM 25. As shown, the CD-ROM 25 stores original music data, connection music data, step data, a timing table, background image data, main part start timing TS, main part end timing TE, and original music reproduction start timing TP, all in a manner associated with each of the game music pieces playable in the music game.

Original music data is data on, for example, general popular music which is stored as original music in the form of PCM streams and so on. In response to an instruction from the CPU 14, the CD-ROM reading device 24 reads original music data, and, if necessary, processes the data. Then, the CD-ROM reading device 24 can supply the data directly, i.e., without passing through the bus 12, to the SPU 20. The SPU 20 then converts the received music data into analogue data, and supplies the converted data to the speaker 22. Connection music data is data concerning a music piece played immediately before a corresponding original music piece, and stored in the form of compressed MIDI data. Step data defines a controller operation procedure for a player to perform in reproduction of corresponding original music data. Step data is configured according to the rhythm of the original music data. Two or more sets of step data may be prepared for a single set of original music data so that a desirable set of step data may be selected depending on a level of difficulty, a play mode, and soon. Step data contains a plurality of data blocks each corresponding to each bar of corresponding original music. Each data block contains information concerning which of the buttons of the controller 32 should be operated at which beat in a corresponding music block when the bars are broken up into blocks for each predetermined beat number such as four beats or eight beats.

A timing table is prepared for matching the timing of corresponding game music with that of the step data. With reference to the timing table, the CPU 14 can specify step data corresponding to the currently playing position in the corresponding original music. Background image data, either motion or still image data, is used for displaying a background image 46 in the game screen 40, shown, for example, in FIG. 3. A background image suitable for the atmosphere of original music is selected for every original music data to visually excite the player.

Main part start timing TS is data specifying timing at which to start playing the main part of original music. Original music comes from general popular music and so on, and often contains, at its beginning or ending, a part unsuitable to serve as game music. Here, a part unsuitable to serve as game music at the beginning of original music is referred to as a preamble, while a part unsuitable to serve as game music at the end thereof is referred to as a post-amble. A part other than a preamble and a post-amble, i.e., a part suitable to serve as game music, of original music, is referred to as a main part. That is, original music comprises a preamble, a main part, and a post-amble in this order. Main part start timing TS is data specifying the time at which the preamble of original music ends and the main part begins. Main part end timing TE is data specifying timing at which the main part of original music ends and the post-amble begins.

Original music reproduction start timing TP is data specifying a time at which to start reproduction of corresponding original music during a period when connection music is output. As described above, original music data is made to correspond to connection music data so that connection music is played before its corresponding original music data. The CPU 14 can know, by referring to original music reproduction start timing TP, the time at which to start outputting the original music during a period when connection music is played. Note that original music reproduction start timing TP is desirably determined such that a period from the original music reproduction start timing TP to end timing of the associated connection music coincides with the length of the preamble of the original music. This arrangement enables immediate outputting of the main part of the original music upon completion of the connection music. Also, the entire length of connection music is desirably determined such that a period from the start timing of the connection music to the subsequent original music reproduction start timing TP is longer than the longest post-amble among those of all original music pieces. This arrangement enables the outputting of connection music either overlapping with or in the place of the post-amble of whichever original music piece is being output before the connection music.

It should be noted that connection music is played overlapping with the preamble of its corresponding original music. Any music suitable to serve as game music to keep a player's tension is selected for connection music. The tempo of connection music is determined so as to correspond to that of its corresponding original music, and more particularly to that of the beginning of the main part of the correlated original music. This arrangement enables a smooth transition from connection music to subsequent original music. Note that the tempo of the connection music is determined based on that of the subsequent original music as described above because the connection music corresponds with subsequent original music here. Alternatively, in the case where connection music corresponds with its preceding original music, the tempo of the connection music may be determined based on that of the preceding original music. Specifically, the tempo of connection music may be set so as to correspond to that of the ending of the original music played immediately before the connection music. This arrangement enables a smooth transition from the original music to the connection music. Further, the tempo of the connection music may be controlled so as to gradually vary from that of the ending of the main part of the original music which is output immediately before the connection music, to that of the beginning of the main part of the original music which is output immediately after the connection music. This arrangement enables smooth transitions from the original music to its immediately subsequent connection music and from the connection music to its immediately subsequent original music.

Figure 5:
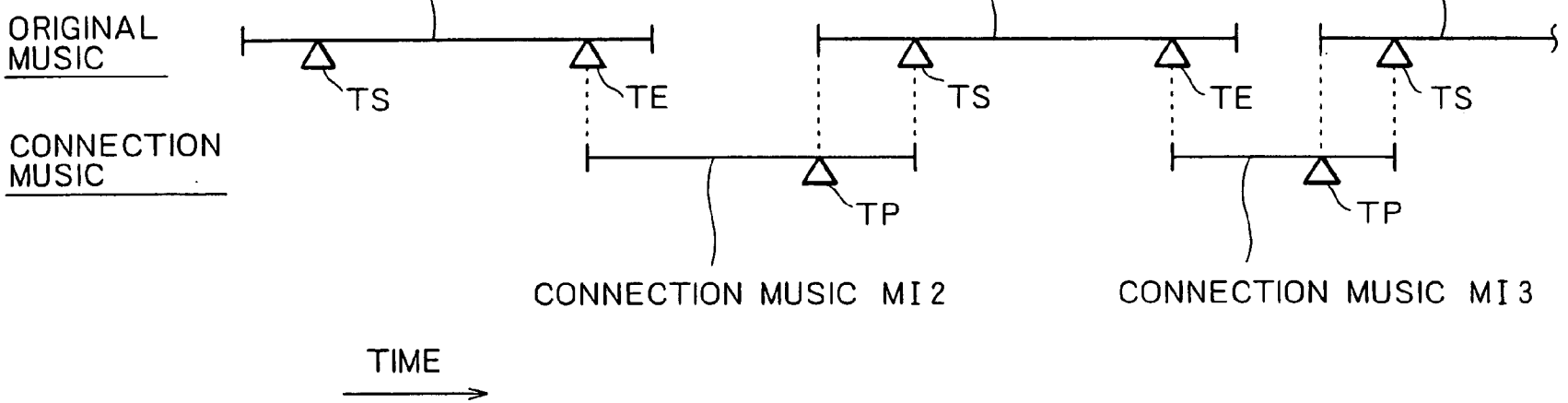
FIG. 5 is a diagram explaining a state where game music pieces are successively output.

FIG. 5 is a diagram describing timing at which to output original music and connection music in the game machine 10, in which original music pieces MO1, MO2, MO3 are sequentially selected for output. In this case, the original music MO2 is played following its corresponding connection music MI2, and the original music MO3 is played following its corresponding connection music MI3. Outputting of connection music correlated to the original music MO1 is cancelled here as the original music MO1 is the first to play. As shown, when main part end timing TE arrives during a period when the original music MO1 is played, the connection music MI2, corresponding with the original music MO2, which is the next game music to play, begins playing. In this transition, desirably, an output volume of the original music MO1 is set at zero or outputting of the original music MO1 is halted upon the start of playing the connection music MI2.

Thereafter, when the original music reproduction start timing TP arrives while playing the connection music MI2, its correlated original music MO2 begins playing. In this transition, desirably, an output volume of the connection music MI2 is maintained above zero while that of the original music MO2 is set at zero. Further, when the main part start timing TS arrives while playing the original music MO2, the output volume of the main part of the original music MO2 is increased to a predetermined level. In the case where the original music reproduction start timing TP is set such that a period from the original music reproduction start timing TP to the end timing of the connection music MI2 coincides with the length of the preamble of the associated original music MO2, as described above, the connection music MI2 naturally finishes playing when the main part start timing TS of the original music MO2 arrives. This is similarly applied to a case where the connection music MI3 is played between the original music MO2 and the original music MO3.

The above arrangement enables immediate start of playing of the connection music MI2 after completion of playing the main part of the original music MO1, and immediate start of playing the main part of the original music MO2 after completion of playing the connection music MI2. This results in successive outputting of rhythmic music pieces suitable to serve as game music, so that a player can keep his tension. Also, a sporting feel can be imparted to this type of music game because the original music pieces MO1, MO2, MO3 are output at relatively short intervals each accompanied by a corresponding game stage. This makes the game more attractive.

Figure 6:
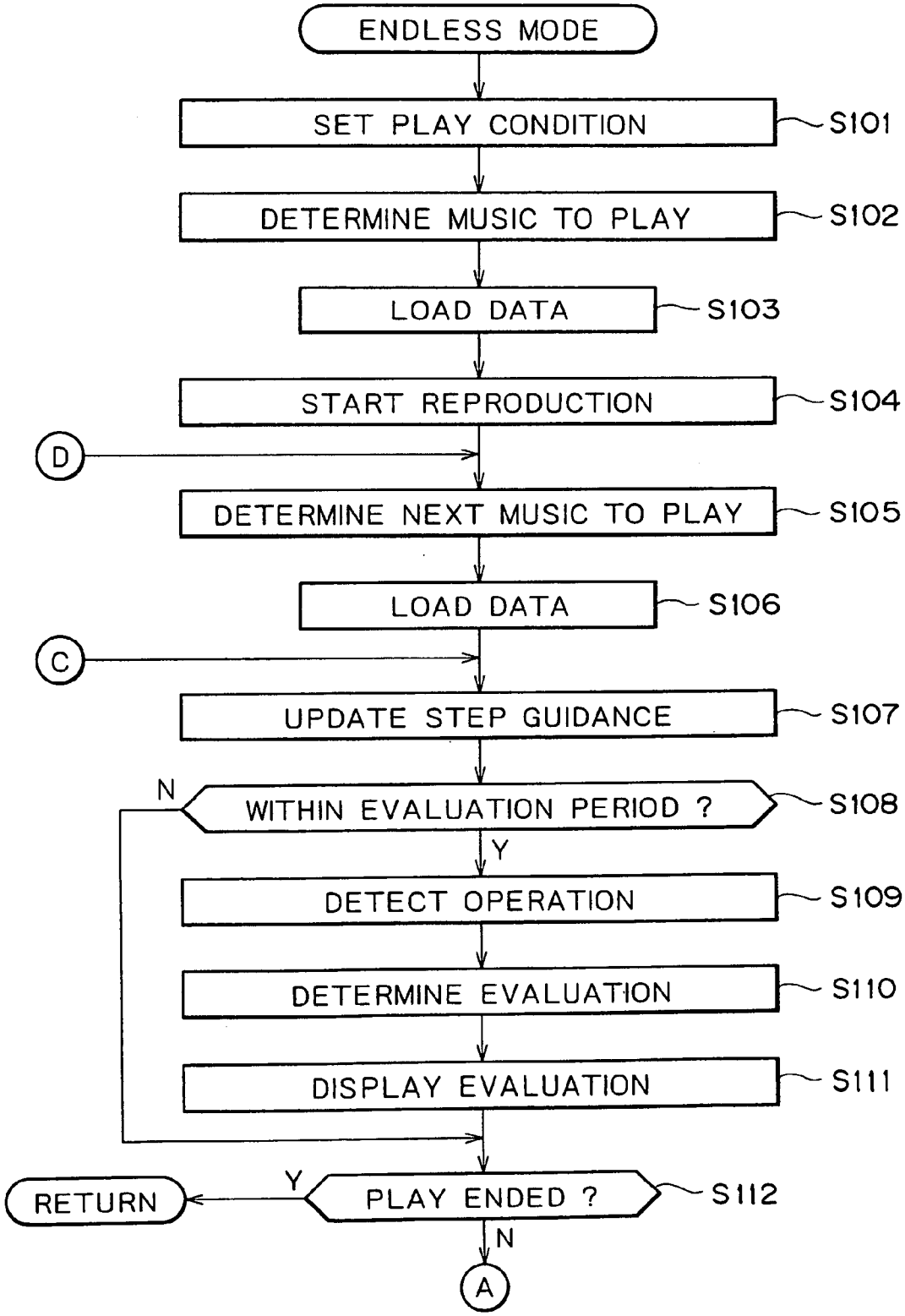
FIG. 6 is a flowchart explaining operation of a game machine according to one preferred embodiment of the present invention.
Figure 7:
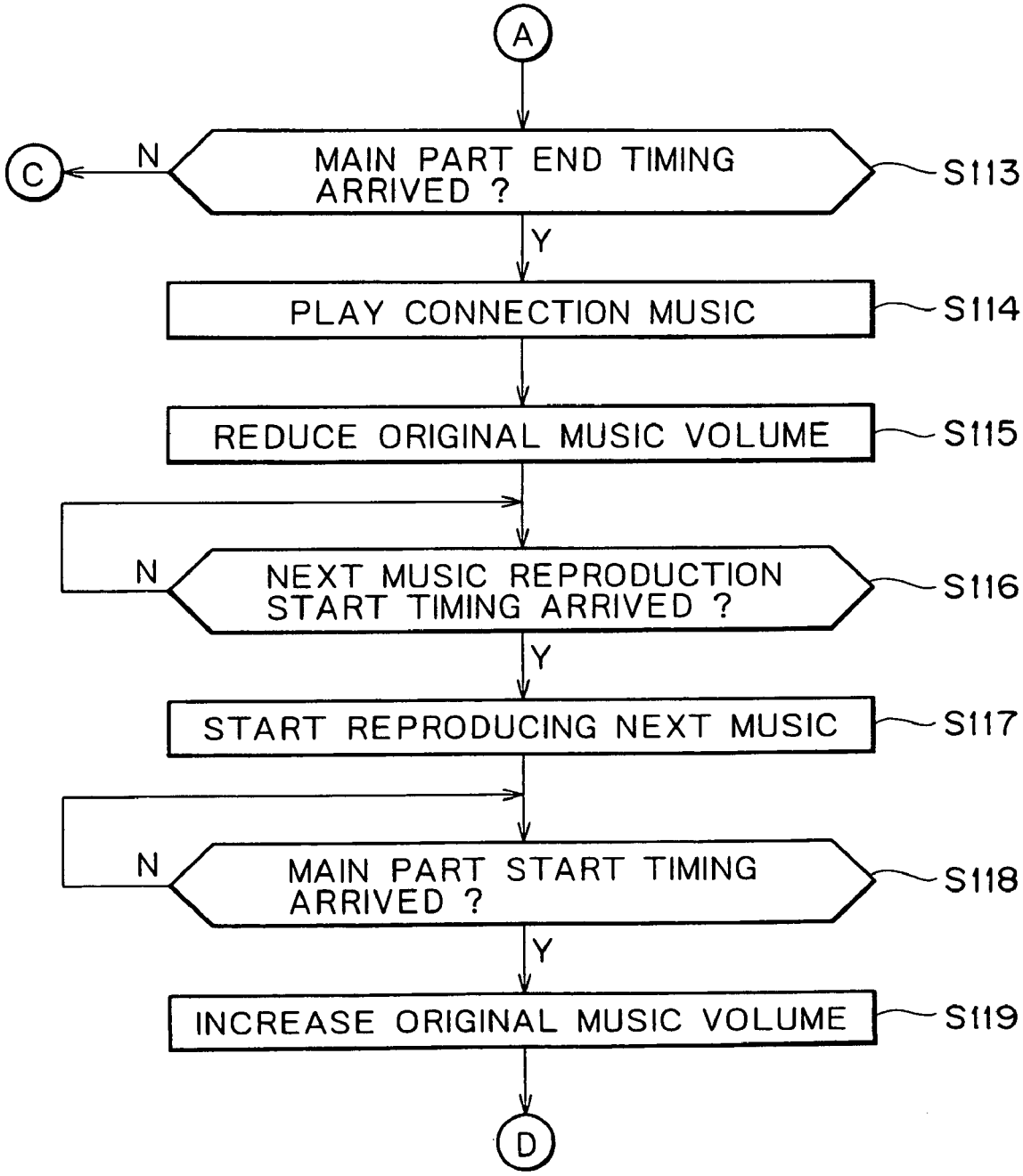
FIG. 7 is a flowchart explaining operation of a game machine according to one preferred embodiment of the present invention.

Here, next described is game program processing executed in the home-use game machine 11. FIGS. 6 and 7 are flowcharts explaining major processing carried out in the home-use game machine 11 by executing a game program stored in the CD-ROM 25. That is, when the player mounts a CD-ROM 25 in the CD-ROM reader 24 and turns on the home-use game machine 11, an operating system stored in the ROM 28 is executed, thereby beginning various initial operations. During the initial operation, a part of the game program, necessary for the present processing, may be read from the CD-ROM 25 and loaded to the RAM 26. According to the game program loaded, a game title and so on is displayed on the monitor 18. Thereafter, a main menu is displayed either automatically or under the control of the controller 32. When the player selects "an endless mode" in the menu, endless processing, which is a characteristic feature of the game machine 10 of the present invention, begins.

In this processing, a play condition setting menu is shown on the monitor 18, requiring the player to input the number of players (one or two), a difficulty level (a play condition), and so on (S101). The input play condition is loaded to the RAM 26. Then, the CPU 14 generates a random number according to known software, and selects one piece of game music for initial playing from among a plurality of pieces of game music stored in the CD-ROM 25 (S102). The CPU 14 loads data on the selected piece of game music (S103). Specifically, data pieces shown in FIG. 4 are loaded. Among them, original music data is supplied from the CD-ROM reader 24 directly to the SPU 20 for immediate outputting (S104), while other data pieces are loaded once to the RAM 26.

The CPU 14 again generates a random number so that the next original music to play is selected from among the plurality of pieces of game music stored in the CD-ROM 25 (S105). Data on that game music piece is additionally loaded (S106). In this case, reproduction of the original music data is reserved.

The CPU 14 then prepares image data for step guidance as shown in FIG. 3, based on step data out of the data loaded at S103, and outputs the prepared image data via the monitor 18 to update the step guidance (S107). Specifically, the CPU 14 judges correspondence between the step data and the original music data with reference to the timing table. Note that the image for step guidance is in conformity with the pre-determined play condition.

Thereafter, whether or not the currently playing position falls within an evaluation period is determined based on the currently playing position and the step data (S108). An evaluation period is a period during which the player's operation timing is compared with a corresponding timing defined by the step data. Specifically, an evaluation period is a period constituting of the preceding and following, each by a predetermined time amount, time periods with respect to certain timing defined as operation timing according to the step data.

For a currently playing position within an evaluation period, the current operation state of the controller 32 is scanned (S109), and the player's game operation is evaluated thereupon (S110). Here, step data indicates in which direction the direction button 34 should be operated or which of the buttons 38X, 38A, 38Y, 38B should be pressed at the operation timing currently falling within the evaluation period. Therefore, whether or not a button operation to be evaluated at that time is actually carried out is determined, and an amount of difference between the actual operation timing and the timing defined by the step data is also determined. A smaller difference in timing may get a higher evaluation. Specifically, the maximum score may be given for no timing difference. On the contrary, zero may be given for a maximum difference, and even a negative score may be given for a wrong operation of the direction button 34 or the button 38, or if no operation is registered. Note that when two or more operations of the direction button 34 and the button 38 must be evaluated at the same time, each button operation is similarly evaluated. The evaluation result is stored in the RAM 26. The last obtained score is added to the accumulated score, which is stored in the RAM 26, whereby a total score is obtained. The total score is displayed as a score 42 (S111). The display state of the dance gauge 50 is accordingly updated. Specifically, the gauge bar extends to the right for higher evaluation, and contracts to the left for lower evaluation. Further, a message 52 is shown on the game screen 40 according to the evaluation acquired in step S110.

Thereafter, the CPU 14 determines whether or not the ongoing game satisfies game end conditions (S112). For example, the game will end when the total score fails to reach a predetermined threshold or when the player continuously presses the start button 36 of the controller 32 over a predetermined time period. When the game ends, the player's overall performance is evaluated based on the content of the RAM 26, and displayed on the monitor 18.

On the other hand, when the game end conditions are not met, the CPU 14 determines whether or not main part end timing TE has arrived (S113), in which the main part end timing TE has been loaded at S103. When the main part end timing TE has not arrived yet, the process returns to S107 to update the step guidance. When the main part end timing TE arrives, on the other hand, the connection music begins playing (S114), and an instruction is given to the SPU 20 so as to reduce an output volume of the original music (S115).

As a result, only the connection music, but no post-amble of the original music, is heard from the speaker 22. Note that connection music corresponds with the next game music to be played here, MIDI data of which has been loaded at S106.

Thereafter, the CPU 14 monitors whether or not original music reproduction start timing TP for the next music has arrived (S116). When original music reproduction start timing TP arrives, the CPU 14 instructs the CD-ROM reader 24 to start reproduction of the next original music (S117). Accordingly, original music data is supplied directly from the CD-ROM reader 24 to the SPU 20, upon which the associated original music immediately begins playing. For the playing, the CPU 14 instructs the SPU 20 to set an output volume of the original music to zero. At that moment, the connection music continues playing. Therefore, only the connection music, but no preamble, is heard from the speaker 22.

The CPU 14 then monitors whether or not the main part start timing TS for the currently playing music has arrived (S118). When main part start timing TS arrives, the CPU 14 instructs the SPU 20 to increase the output volume of the original music (S119). At that timing, the connection music automatically finishes playing, and the process returns to step S105.

According to the above described game machine 10, game music is sequentially selected according to a random number, so that the player can continuously enjoy the game operation and thus keep his excitement. Also, as a sporting feel can be imparted to this type of music, the game machine 10 becomes more attractive.

As described above, only a part of original music, i.e., a main part, which is suitable to serve as game music, is used as game music, while other parts, i.e., a preamble and a post-amble, are overlapped with by connection music. Therefore, when music suitable to serve as game music is selected to serve as connection music, music with intention and salutation can be continuously played. This contributes to keeping the player's tension even during an interval between the game music pieces.

It should be noted that the present invention is not limited to the above.

For example, whereas the present invention is applied to a home-use game machine 11 in the above, the present invention can be similarly applied to a business use game machine (arcade game machine). In this case, preferably, a faster storage device than a CD-ROM 25 and a built-in monitor 18 and speaker 22 may be used.

Further, the present invention is applicable not only to a music game, as described above, but also to other types of games. For example, when general popular music is used as BGM of a combat game, the preamble or post-amble of such general music maybe replaced by connection music, which is more suitable to maintain game tension. This makes the combat game become still more attractive.

Figure 8:
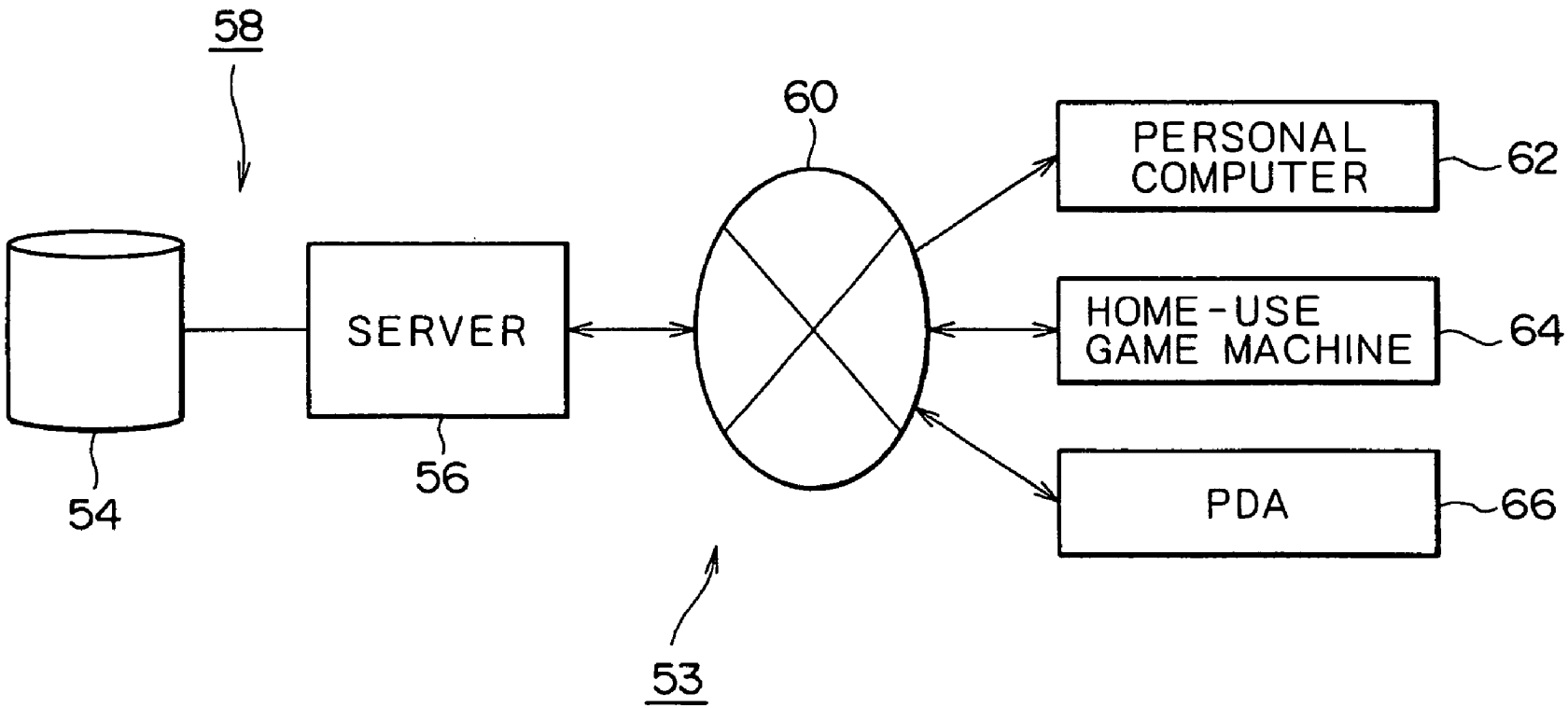
FIG. 8 is a diagram showing a complete structure of a game program distribution system according to another preferred embodiment of the present invention.

Still further, whereas a game program and game data are provided from a CD-ROM 25, or an information storage medium, to a home-use game machine 11 in the above, a game program and game data may be distributed through a communication network to each home. FIG. 8 is a diagram showing a complete structure of a game program distribution system utilizing a communication network. As shown, a game program distribution system 53 comprises a game data base 54, a server 56, a communication network 60, a personal computer 62, a home-use game machine 64, and a PDA (Personal Digital Assistance) 66, wherein the game database 54 and the server 56 together constitute a game program distribution device 58. The communication network 60 may be, for example, the Internet or a cable television network. In this system, the game database 54 stores a game program and game data, similar to those stored in the CD-ROM 25. When a user makes a request for a game distribution, using the personal computer 62, the home-use game machine 64, the PDA 66, or the like, the request is forwarded to the server 56 via the communication network 60. In response to the request, the server 56 reads the game program and game data from the game database 54 and transfers them to the requesting entity, such as the personal computer 62, the home-use game machine 64, the PDA 66, or the like. Note that although a game distribution is effected in response to a game distribution request in the above, the server 56 may transmit them one-sidedly. Also, game programs and game data necessary for playing a game may not necessarily be all distributed at the same time, and only those necessary for each aspect of the game may be distributed at an appropriate timing. Game distribution via a communication network 60 as described above allows a person to easily obtain a game unique to the present invention, which allows the player to keep his tension through successive reproduction of game music pieces.

What is claimed is:

1. A game machine, comprising:

original music storage means for storing audio data concerning original music containing a preamble and a main part subsequent thereto;

connection music storage means for storing audio data concerning predetermined connection music corresponding to the original music;

original music reproduction start timing storage means for storing original music reproduction start timing data indicative of reproduction start timing of the original music during performance of the connection music, which is set such that a period between the reproduction start timing and the end timing of the connection music coincides with the length of the preamble of the corresponding original music;

connection music output means for outputting the connection music based on the audio data concerning the connection music;

original music reproduction start timing monitoring means for monitoring original music reproduction start timing based on the original music reproduction start timing data during a period when the connection music is output;

original music reproduction means for beginning reproduction of the original music while overlapping with the connection music, upon arrival of original music reproduction start timing.

2. A game machine according to claim 1, further comprising:

volume control means for controlling an output volume of the connection music.

3. A game machine according to claim 1 or claim 2, further comprising:

volume control means for controlling an output volume of the preamble of the original music.

4. A game machine according to claim 3, wherein a tempo of the connection music is determined based on a tempo of the main part of the original music.

5. A game machine according claim 3, wherein a tempo of the connection music is pre-determined as stored, based on a tempo of the main part of another original music.

6. A game machine according to claim 3, further comprising:

connection music tempo control means for controlling a tempo of the connection music so as to gradually vary from a tempo based on a tempo of the main part of a first original music to a tempo based on a tempo of the main part of a second original music.

7. A game machine according to claim 1 or claim 2, wherein a tempo of the connection music is determined, based on a tempo of the original music.

8. A game machine according to claim 1 or claim 2, wherein a tempo of the connection music is determined as stored, based on a tempo of the original music.

9. A game machine according to claim 1 or claim 2, further comprising:

connection music tempo control means for controlling a tempo of the connection music so as to gradually vary based on a tempo of the original music.

10. A game machine according to claim 1, wherein the original music reproduction means begins reproduction of the original music while maintaining the output volume at zero.

11. A game machine according to claim 1, wherein said connection music output means and said original music reproduction means are operative during automatic game play.

12. A game machine according to claim 1, wherein said connection music has a duration that is substantially shorter than the duration of said original music.

13. A game music output method for outputting original music, having a preamble and a main part subsequent thereto, and predetermined corresponding connection music, which is executable during automated game play, comprising:

a timing storing step of storing original music reproduction start timing data indicative of a reproduction start timing of the original music during performance of the connection music, which is set such that a period between a reproduction start timing and an end timing of the connection music coincides with the length of the preamble of the corresponding original music;

an original music reproduction start timing monitoring step of monitoring original music reproduction start timing based on the original music reproduction start timing data during a period when the connection music is output;

an original music output step of outputting at least the original music containing a preamble and the main part subsequent thereto; and a connection music output step of outputting said predetermined connection music corresponding to the original music; and an original music reproduction step of beginning reproduction of the original music while overlapping with the connection music, upon arrival of original music reproduction start timing.

14. A game program distribution device for distributing a program, said program being operative for causing a computer to execute a plurality of steps, said steps comprising:

a first original music output step of outputting during automated game play at least a main part and a postamble subsequent thereto of first original music;

a second original music output step of outputting during automated game play at least a preamble and a main part subsequent thereto of second original music; and a connection music output step of outputting during automated game play predetermined connection music, having a specific predefined association including start timing with said original music as stored, during a period between main part end timing of the first original music and main part start timing of the second original music, and concurrent with at least the output of said preamble.

15. A game program distribution method for distributing a program, said program being operative for having a computer to execute a plurality of steps, said steps comprising:

a first original music output step of outputting during automated game play at least a main part and a postamble subsequent thereto of first original music;

a second original music output step of outputting during automated game play at least a preamble and a main part subsequent thereto of second original music; and a connection music output step of outputting during automated game play predetermined connection music, having a specific predefined association including start timing with said original music as stored, during a period between main part end timing of the first original music and main part start timing of the second original music, and concurrent with at least the output of said preamble.

16. A game machine of which controller is operated by a player in accordance with game music, comprising:

input means for setting a play condition including a number of players and difficulty;

play condition storage means for storing the play condition set; and game advancing means for advancing a game during automated game play according to the play condition stored during successive reproduction of the game music based on a plurality of pieces of original music, wherein, the game advancing means includes original music output means for outputting during automated game play, as a part of the game music, at least original music containing a preamble, and a main part, in this order;

connection music output means for outputting during automated game play predetermined connection music, having a specific predefined association including start timing with said original music as stored, at least during the output of said preamble;

original music determination means for determining during automated game play next original music to output; and timing control means for controlling during automated game play the original music output means and the connection music output means such that the connection music is output during a period between a reproduction start timing and an end timing of the connection music such that it coincides with the length of the preamble of the corresponding original music as determined by said predefined association including start timing.

17. A game machine according to claim 16, wherein the game advancing means further comprises timing guidance image display means for displaying timing guidance image in conformity with the play condition stored in the play condition storage means, for guiding timing at which the player is to operate the controller in accordance with the game music.

18. A game machine according to claim 16 or claim 17, wherein the original music determination means determines original music to output based on a random number.

19. A game machine, comprising:

original music storage for storing audio data concerning at least a main part of original music containing a preamble and a main part subsequent thereto;

connection music storage for storing audio data concerning predetermined connection music prior to selection of original music for playback, said connection music having a specific predefined association including reproduction start timing with said original music as stored;

original music reproduction start timing storage means for storing original music reproduction start timing data indicative of reproduction start timing of the original music during performance of the connection music, which is set such that a period between the reproduction start timing and the end timing of the connection music coincides with the length of the preamble of the corresponding original music;

connection music output means for outputting the connection music based on the audio data concerning the connection music;

original music reproduction start timing monitoring means for monitoring original music reproduction start timing based on the original music reproduction start timing data during a period when the connection music is output; and original music reproduction means for beginning reproduction of the original music while overlapping with the connection music, upon arrival of original music reproduction start timing.

20. A game machine, comprising:

original music storage for storing audio data concerning original music containing a preamble and a main part subsequent thereto;

connection music storage for storing audio data concerning connection music which is pre-associated with original music;

original music reproduction start timing storage for storing original music reproduction start timing data which is associated with original music and connection music and is indicative of the associated original music reproduction start timing during a period when the associated connection music is output, and which is set such that a period from the original music reproduction start timing to the end timing of the associated connection music coincides with the length of the preamble of the associated original music;

a connection music output unit which outputs during automated game play the connection music based on the audio data concerning the connection music associated with following original music;

an original music reproduction start timing monitor for monitoring original music reproduction start timing data during a period when the connection music is output; and an original music reproduction unit which begins reproduction of the preamble of the original music upon arrival of original music reproduction start timing while the associated connection music is output.

21. A computer readable storage medium containing a computer program for causing a computer to execute a plurality of steps, said steps comprising:

a timing storing step of storing original music reproduction start timing data indicative of a reproduction start timing of the original music during performance of the connection music, which is set such that a period between a reproduction start timing and an end timing of the connection music coincides with the length of the preamble of the corresponding original music;

an original music reproduction start timing monitoring step of monitoring original music reproduction start timing based on the original music reproduction start timing data during a period when the connection music is output;

an original music output step of outputting at least the original music containing a preamble and the main part subsequent thereto;

a connection music output step of outputting said predetermined connection music corresponding to the original music; and an original music reproduction step of beginning reproduction of the original music while overlapping with the connection music, upon arrival of original music reproduction start timing.

* * * * *